US010470567B1

(12) United States Patent
Wenning et al.

(10) Patent No.: US 10,470,567 B1
(45) Date of Patent: Nov. 12, 2019

(54) DRAWER SLIDE JIG

(71) Applicant: Rockler Companies, Inc., Medina, MN (US)

(72) Inventors: Daniel Lloyd Wenning, Minnetonka, MN (US); Steven Donald Krohmer, Coon Rapids, MN (US); Jacob Justin Stoesz, Golden Valley, MN (US)

(73) Assignee: Rockler Companies, Inc., Medina, MN (US)

( * ) Notice: Subject to any disclaimer, the term of this patent is extended or adjusted under 35 U.S.C. 154(b) by 603 days.

(21) Appl. No.: 14/955,684

(22) Filed: Dec. 1, 2015

Related U.S. Application Data

(60) Provisional application No. 62/085,854, filed on Dec. 1, 2014.

(51) Int. Cl.
*B25B 1/00* (2006.01)
*A47B 88/04* (2006.01)
*B25B 11/02* (2006.01)

(52) U.S. Cl.
CPC ..... *A47B 88/04* (2013.01); *B25B 11/02* (2013.01)

(58) Field of Classification Search
CPC ..... B25B 11/02; A47B 88/04
See application file for complete search history.

(56) References Cited

U.S. PATENT DOCUMENTS 2,642,905 A * 6/1953 Hewat ..... B25B 5/003 269/156
3,246,399 A 4/1966 Southern
3,583,823 A 6/1971 Eaton
4,556,205 A 12/1985 Rock
4,684,299 A 8/1987 Laliberte
5,018,711 A * 5/1991 Johnson ..... B25B 5/067 269/249
5,064,319 A 11/1991 Ericksen
5,431,381 A 7/1995 Smed
5,507,607 A 4/1996 Ericksen
D428,285 S 7/2000 Hughes
6,527,265 B1 3/2003 Goodding
6,648,315 B1 * 11/2003 Lee ..... B25B 5/068 269/166
6,719,282 B2 4/2004 Frank
7,168,181 B2 1/2007 Walchak
7,281,338 B2 10/2007 Ziegmann
D554,485 S 11/2007 Dubon
(Continued)

*Primary Examiner* — Ryan J. Walters
(74) *Attorney, Agent, or Firm* — Mai-Tram D. Lauer; Westman, Champlin & Koehler P.A.

(57) ABSTRACT

In a first aspect, a tool is disclosed for use in installing a drawer slide having a bottom surface and a top surface. The tool includes a ledge for supporting the bottom surface of the drawer slide; and a movable member for contacting the top surface of the drawer slide, wherein movement of the movable member changes a distance between the ledge and the movable member. In another aspect, a method of using a tool is disclosed to position a drawer slide proximate a furniture surface of a furniture box, the drawer slide having a first surface and a second surface. The method includes positioning the first surface of the drawer slide on a ledge of the tool; moving a movable member to contact the second surface of the drawer slide; placing the tool proximate the furniture surface; and attaching the drawer slide to the furniture surface.

20 Claims, 9 Drawing Sheets

(56) References Cited

U.S. PATENT DOCUMENTS

| | | | | |
|---|---|---|---|---|
| D562,117 | S | 2/2008 | Dubon | |
| D599,648 | S | 9/2009 | Dubon | |
| D618,087 | S | 6/2010 | Stafford | |
| 7,979,998 | B2 | 7/2011 | Ziegmann | |
| D695,599 | S | 12/2013 | Rechberg | |
| 2011/0107615 | A1* | 5/2011 | Ziegmann | A47B 88/00 33/645 |

* cited by examiner

DRAWER SLIDE JIG

CROSS REFERENCE TO RELATED APPLICATION

This application claims the benefit of priority from U.S. Provisional Patent Application Ser. No. 62/085,854, filed Dec. 1, 2014, entitled "Drawer Slide Jig," which is fully incorporated herein by reference.

BACKGROUND

In cabinetry, a common task for furniture building includes the installation of metal drawer slides in cabinet boxes or furniture shells to build drawer cabinets, dressers, chests, desks, entertainment centers, and other drawer units. Proper functioning of drawers or pull-out shelves requires careful installation of a slide. A typical slide includes a stationary component and a movable component. The moving component is typically designed to slide in and out of a channel in the stationary component. Such slides are commonly referred to as "drawer slides" even when used for shelves. Typically, two slides are used for each drawer, with one on each of left and right sides of the drawer. The term "furniture" as used herein describes not only stand-alone pieces, but also built-in furniture such as cabinetry and shelving, for example.

In one typical installation, the stationary component of a slide is installed against an interior vertical side wall of a box or like structure into and out of which the drawer slides. Generally, the stationary components of the slides are installed in pairs on opposing interior vertical side walls of the box. The movable components are generally installed on opposing exterior vertical side walls of a drawer or shelf. The slides are oriented substantially horizontally lengthwise. If the pair of stationary components is not aligned at the same height and parallel to each other, the drawer or shelf may not slide correctly, resulting in binding, sticking, and other problems.

In another type of installation, the stationary component is installed in the center of the box. In this case, the movable component is generally installed on a bottom exterior horizontal surface of a drawer or shelf.

SUMMARY

In a first aspect, a tool is disclosed for use in installing a drawer slide having a bottom surface and a top surface. The tool comprises a ledge for supporting the bottom surface of the drawer slide; and a movable member for contacting the top surface of the drawer slide, wherein movement of the movable member changes a distance between the ledge and the movable member.

In another aspect, a method of using a tool is disclosed to position a drawer slide proximate a furniture surface of a furniture box, the drawer slide having a first surface and a second surface. The method comprises positioning the first surface of the drawer slide on a ledge of the tool; moving a movable member to contact the second surface of the drawer slide; placing the tool proximate the furniture surface; and attaching the drawer slide to the furniture surface.

This disclosure, in its various combinations, either in apparatus or method form, may also be characterized by the following listing of items:

1. A tool for use in installing a drawer slide having a bottom surface and a top surface, the tool comprising:

a ledge for supporting the bottom surface of the drawer slide; and a movable member for contacting the top surface of the drawer slide, wherein movement of the movable member changes a distance between the ledge and the movable member.

2. The tool of item 1 further comprising an inclined channel in which a part of the movable member moves.

3. The tool of any of items 1-2 further comprising:

a lower portion from which the ledge extends; and an aperture between the inclined channel and the lower portion.

4. The tool of any of item 3 further comprising a support between the lower portion and the inclined channel.

5. The tool of any of item 4 further comprising a recess in the ledge located proximate the support.

6. The tool of any of items 1-5 further comprising a clamp plate oriented substantially orthogonally to the ledge.

7. The tool of item 6 further comprising a gap between the clamp plate and the ledge.

8. The tool of any of items 1-7 further comprising:

a body including the ledge; and a rod comprising a foot, wherein the rod is adjustably attachable to the body.

9. The tool of item 8 wherein the body further comprises a plurality of guides through which the rod is insertable.

10. The tool of item 9 wherein the plurality of guides are located on a top portion of the body.

11. The tool of item 9 wherein the plurality of guides are located on a front portion of the body.

12. The tool of any of items 8-11 further comprising a knob for selectively securing the rod relative to the body.

13. The tool of any of items 1-12 further comprising a handle.

14. A method of using a tool to position a drawer slide proximate a furniture surface of a furniture box, the drawer slide having a first surface and a second surface, the method comprising:

positioning the first surface of the drawer slide on a ledge of the tool;

moving a movable member to contact the second surface of the drawer slide;

placing the tool proximate the furniture surface; and attaching the drawer slide to the furniture surface.

15. The method of item 14 wherein moving the movable member comprises sliding a part of the movable member along a channel that is inclined relative to the ledge.

16. The method of any of items 14-15 further comprising inserting an indexing rod through a plurality of guides.

17. The method of item 16 further comprising securing the rod at a desired location relative to a body of the tool.

18. The method of item 17 wherein securing the rod at the desired location relative to the body of the tool comprises turning a knob to frictionally engage the rod against the body of the tool.

19. The method of any of items 16-18 wherein the rod comprises a foot at an end thereof, the method further comprising locating the foot at a reference location on the furniture box.

20. The method of any of items 14-19 further comprising clamping the tool to the furniture box.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

Figure 1:
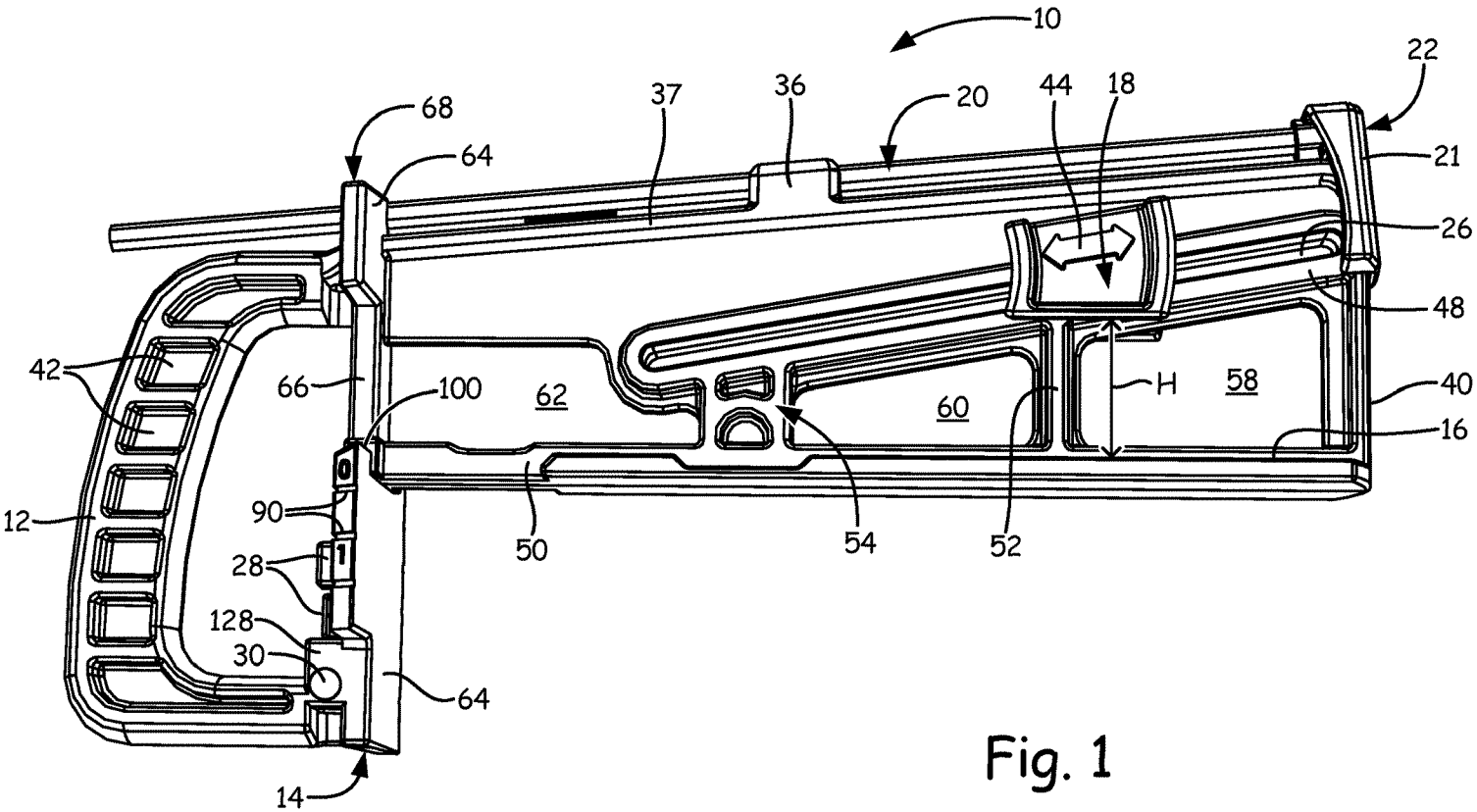
FIG. 1 is a side view of an exemplary drawer slide jig of the present disclosure.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

FIGS. 1-8 show a tool for use in cabinetry to position a drawer slide on an interior wall of a structure for holding drawers, such as a cabinet, dresser, chest, desk, entertainment center, or other drawer unit. Such a structure will be referred to in this disclosure as furniture box 32 (see FIG. 2, for example). The tool, referred to herein as jig 10, includes, among other parts, handle 12, clamp plate 14, drawer slide bottom support ledges 16, drawer slide top support wedge 18, and indexing rod 20 having indexing foot 22.

Indexing rod 20 is removably held on jig 10 between guides 36 and 38. Indexing foot 22 is fixed to an end of indexing rod 20. In an exemplary embodiment, an exterior surface 21 of indexing foot 22 is relatively flat, while an interior surface 23 (see FIGS. 4A and 4B) of indexing foot 22 is shaped to provide a friction-fit engagement with back surface 40 of jig 10. Accordingly, indexing rod 20 with its indexing foot 22 remains securely attached to jig 10 in the position showing in FIG. 1 when not in use. In FIGS. 2, 3, 6 and 8, indexing rod 20 has been removed from jig 10.

In an exemplary embodiment, handle 12 has an ergonomic, rounded shape that is comfortable to grip. In the illustrated embodiment, recesses 42 are provided in handle 12 to reduce the amount of material used and the weight associated therewith. Accordingly, jig 10 is light in weight and therefore comfortable to use, without unduly contributing to user fatigue.

Figure 3:
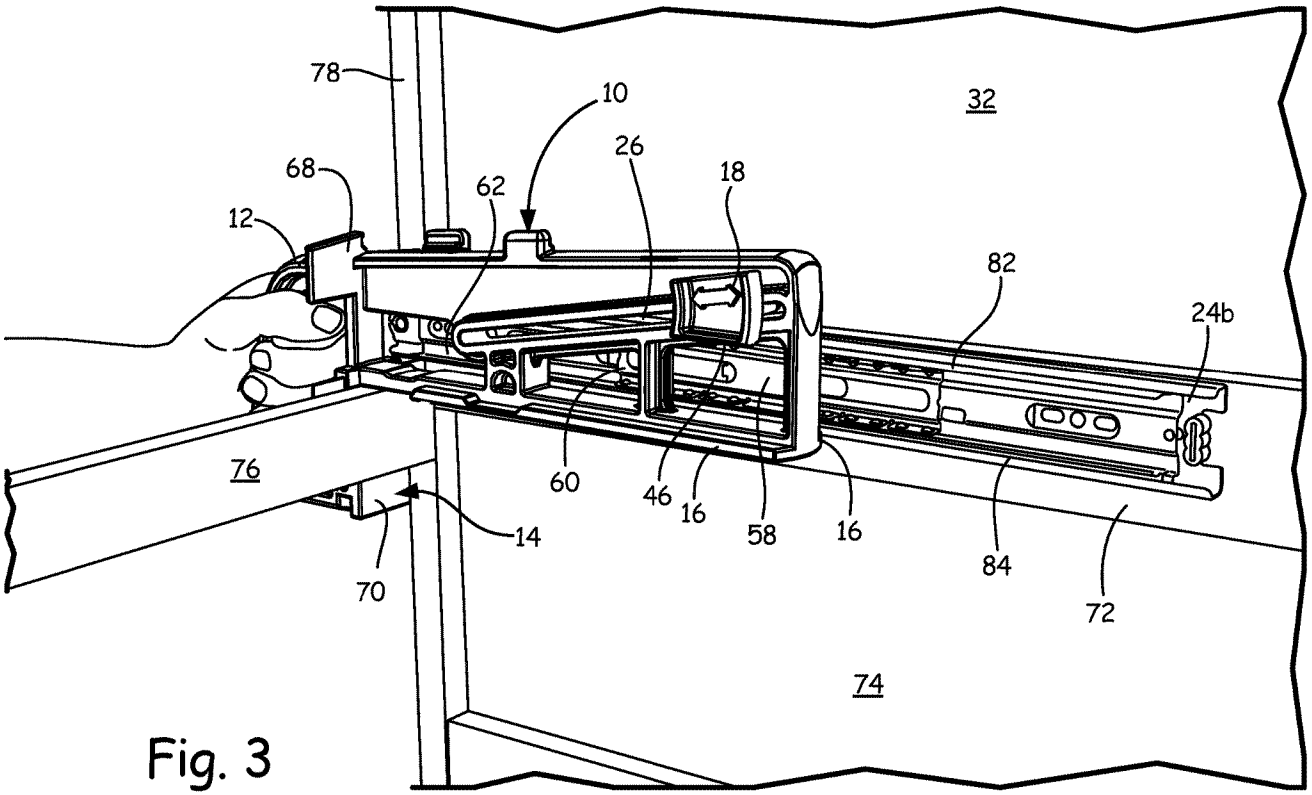
FIG. 3 is a perspective view of the jig manually held relative to a furniture box.
Figure 4A:
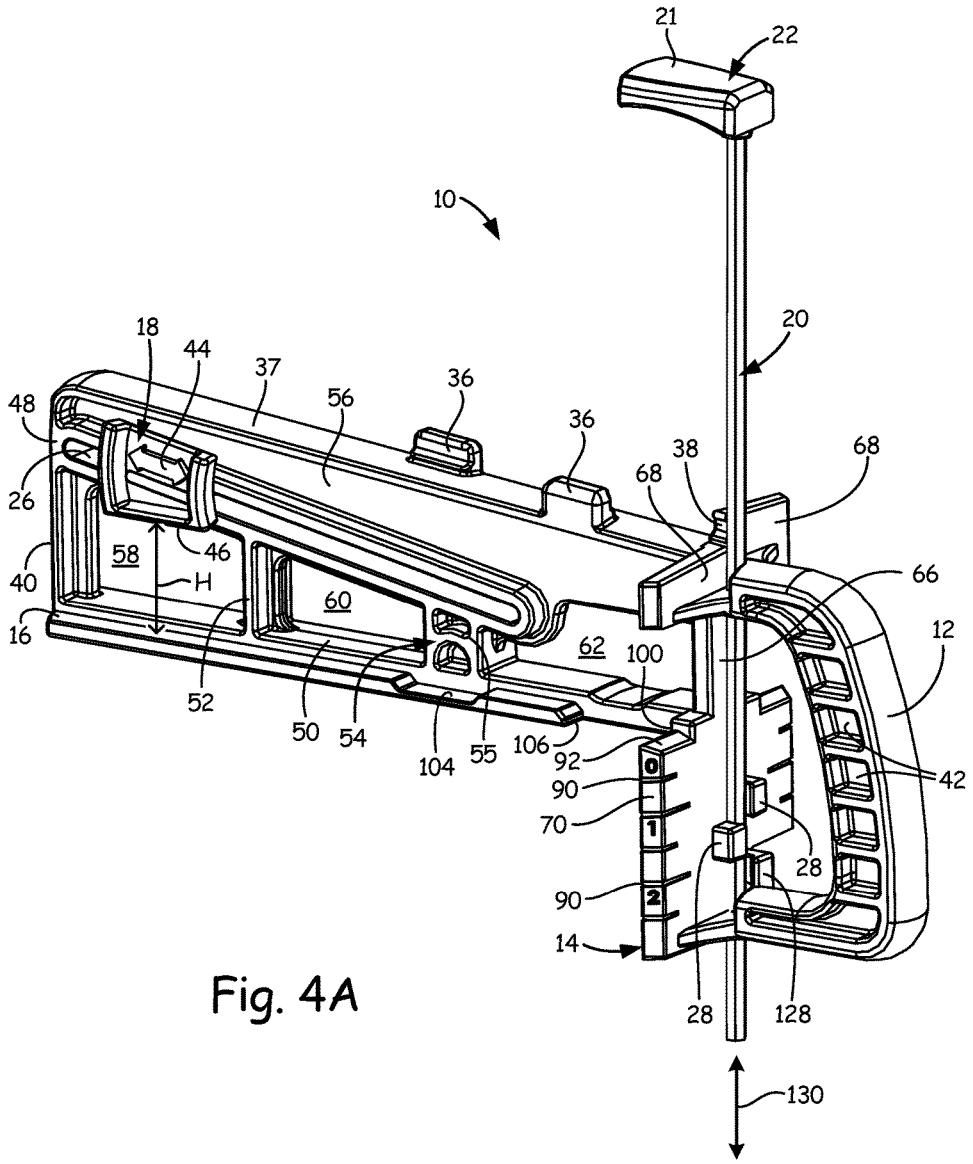
FIG. 4A is a perspective view of the jig with an indexing rod inserted so that its index foot is in an "up" position.
Figure 4B:
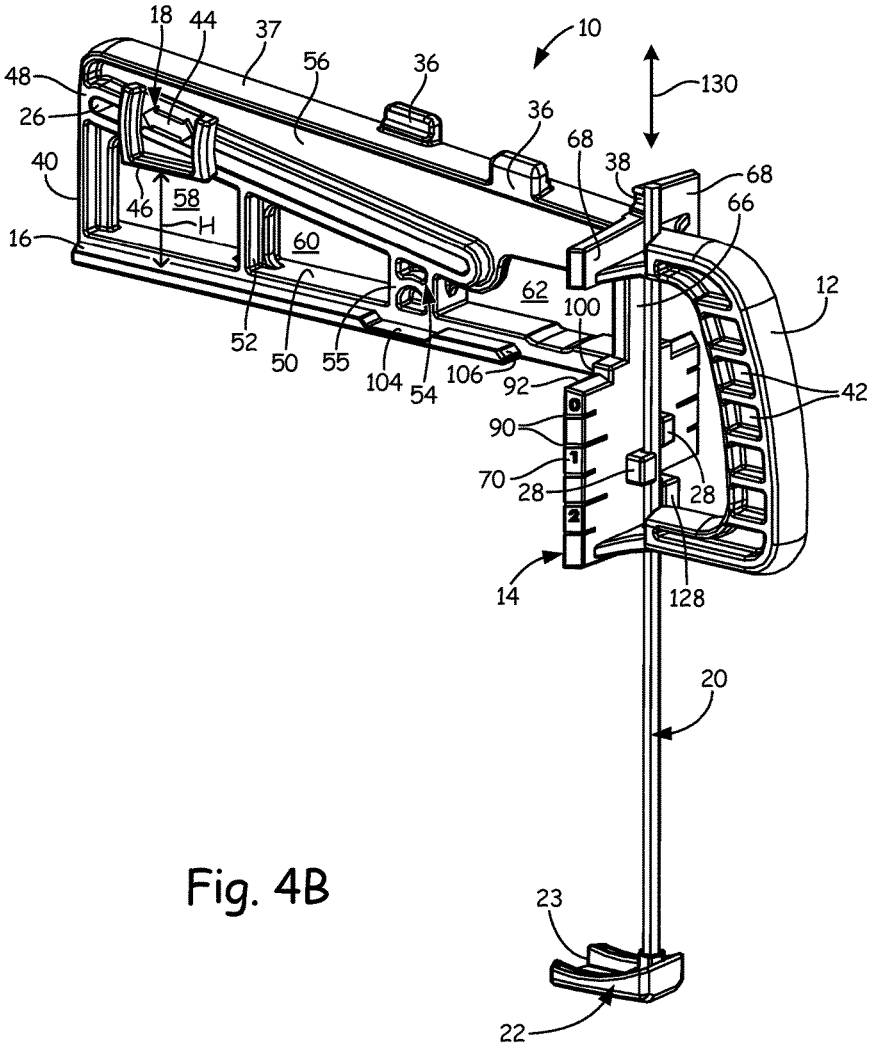
FIG. 4B is a perspective view of the jig with an indexing rod inserted so that its index foot is in a "down" position.

As shown in FIGS. 1, 4A and 4B, in an exemplary embodiment, left and right sides of jig 10 are mirror images of each other below upper portion 37 and rearward of clamp plate 14. A part of wedge 18 is received within slide channel 26 of jig 10 so that wedge 18 is movable in the directions indicated by arrow 44 within channel 26. Because channel 26 is inclined with respect to each ledge 16, a distance H between bottom surface 46 of wedge 18 and support ledge 16 changes as wedge 18 moves along channel 26. In an exemplary embodiment, distance H ranges from about ¾ inch to about 1⅞ inches; however, it is contemplated that other ranges of H may also be used. In an exemplary embodiment, wedge has a bottom surface 46 to frictionally engage a top surface 82 of a drawer slide 24, 94. (See FIGS. 2, 3, 5, 7 and 8) While referred to herein as a "wedge," it is to be understood that the movable drawer slide top support member 18 can also be formed in other shapes, including, for example, a square or rectangle.

In an exemplary embodiment, channel 26 is formed as an elongated slot in portion 48 of jig 10. Portion 48 is attached to lower portion 50 by supports 52 and 54. In an exemplary embodiment, support 54 is wider than support 52 to offer additional strength while minimizing the number of required supports in order to maintain the large spaces of apertures 58, 60 and 62. Moreover, the side face 55 of support 54 provides a clamping surface, as shown in FIG. 8 and discussed further below.

Guides 36 for retaining indexing rod 20 on the body of jig 10 are provided on upper portion 37, while guides 38 and 28 are provided on clamp plate 14. In an exemplary embodiment, clamp plate 14 includes clamping surface 64 having a large footprint. In an exemplary embodiment, clamping surface 64 extends for the full width and height of jig 10 to provide a large substantially planar surface against which jig 10 may be aligned against a furniture box surface. In an exemplary embodiment, separate upper and lower portions of clamp plate 14 are provided at front portion 66 of jig 10. Together, upper clamp plate portion 68 and lower clamp plate portion 70 form an extensive clamping surface 64, while minimizing material usage and weight. Panel 56 extends between portion 48, back portion 40, upper portion 37, and front portion 66 to offer rigidity to jig 10.

Figure 2:
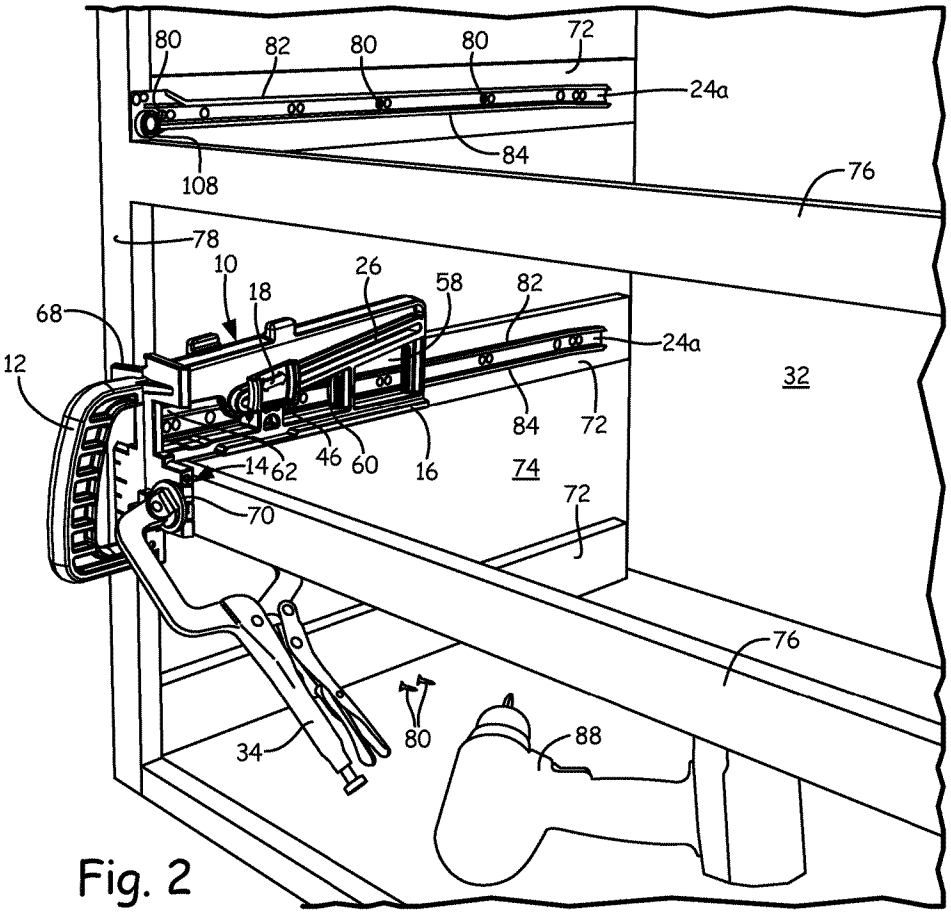
FIG. 2 is a perspective view of the jig clamped to a furniture box in a first configuration.
Figure 5:
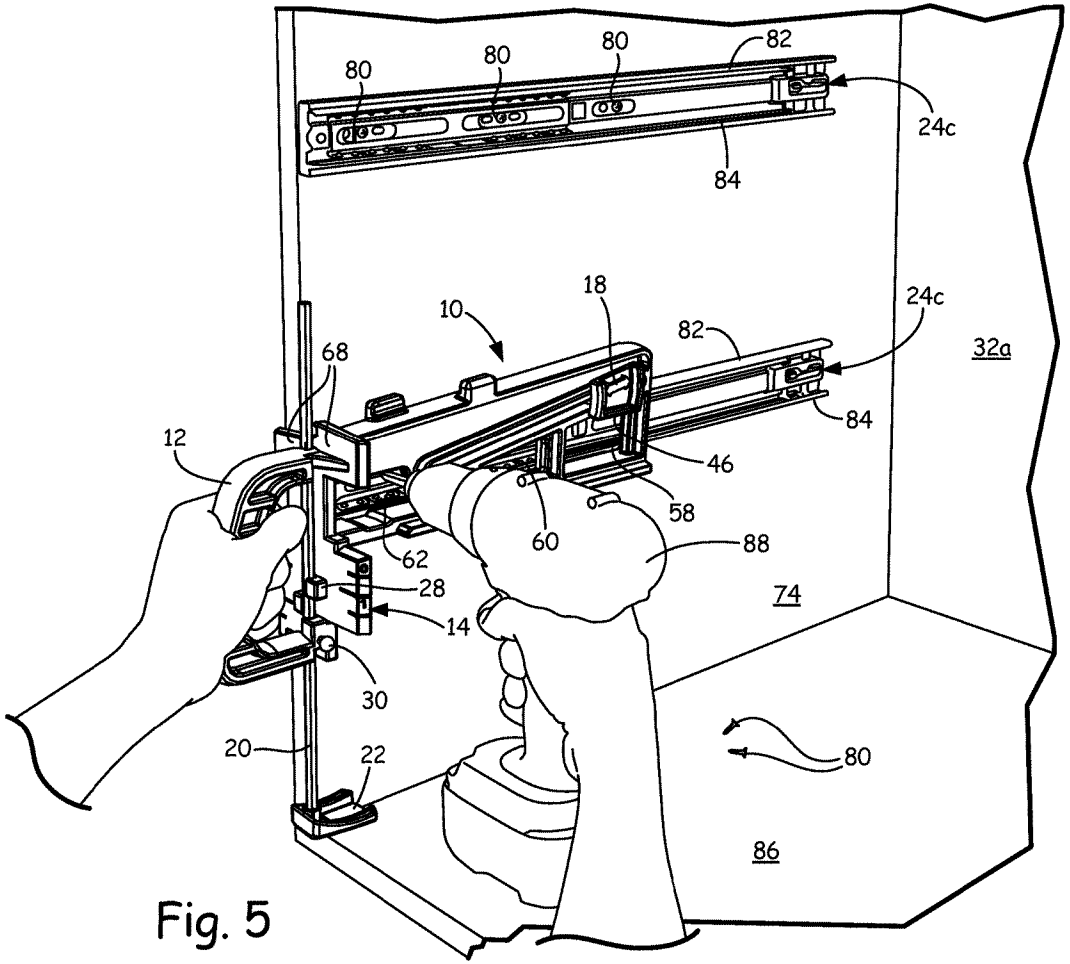
FIG. 5 is a perspective view of the jig being manually held relative to a furniture box, with its indexing rod and indexing foot in a "down" position.
Figure 6:
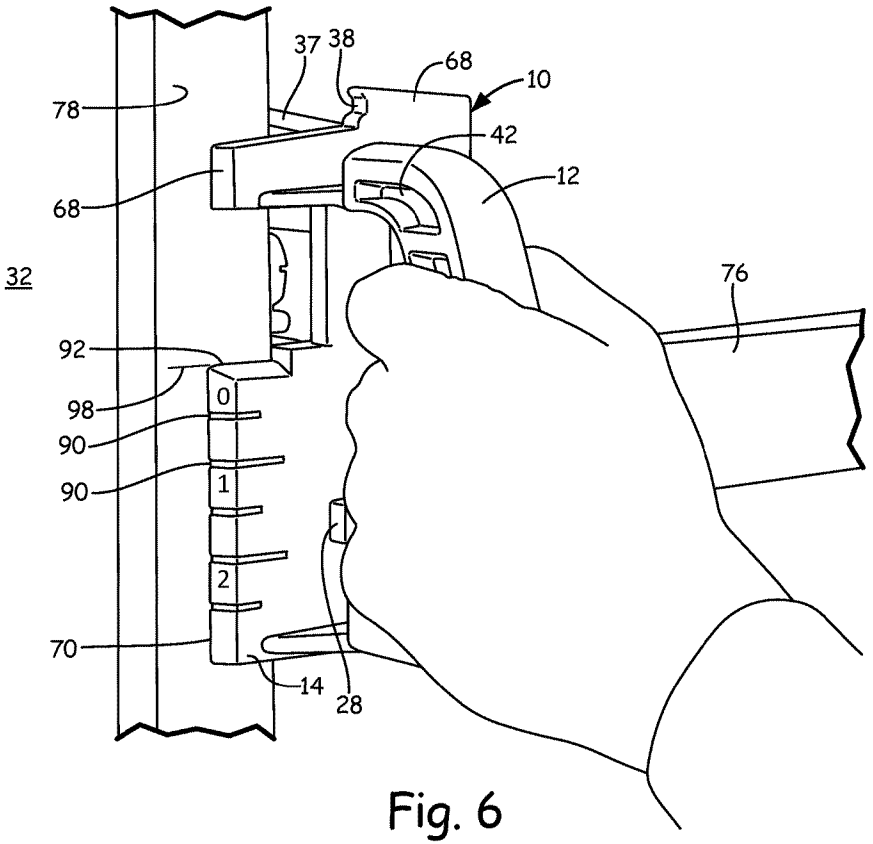
FIG. 6 is a partial view of the jig showing gauge markings on the clamp plate.
Figure 8:
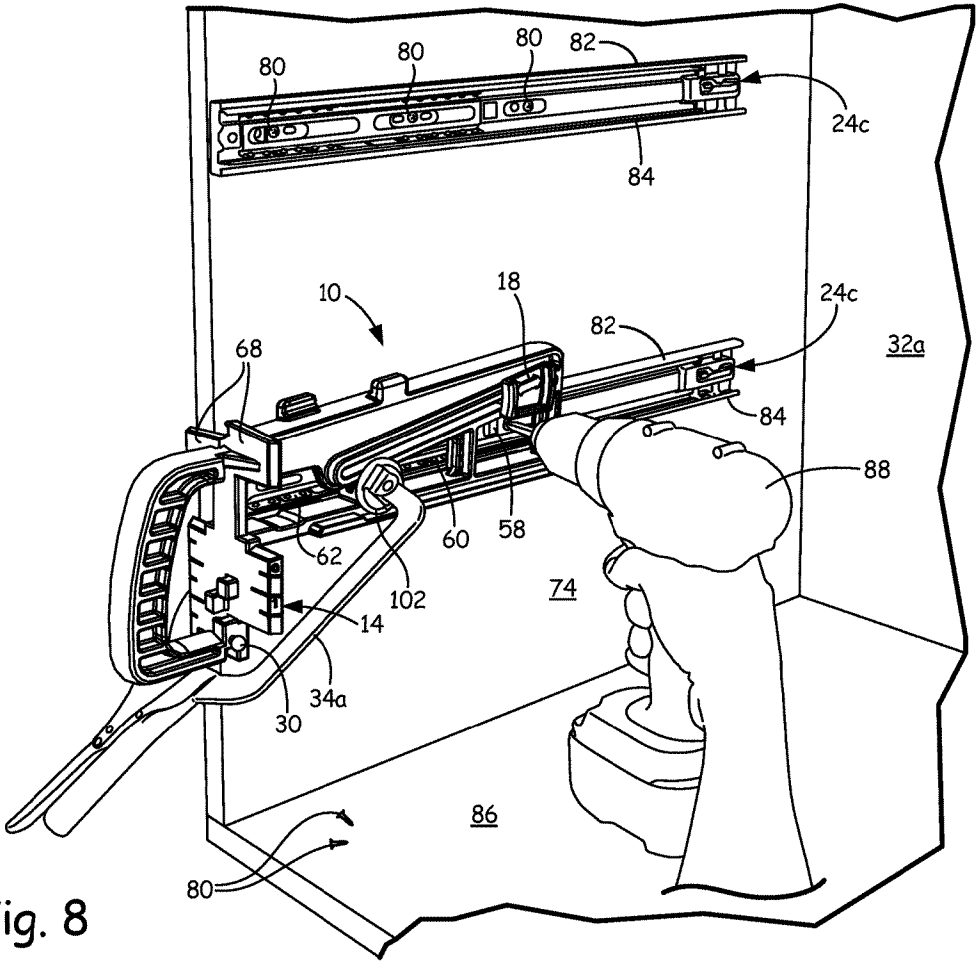
FIG. 8 is a perspective view of the jig of FIG. 1 clamped to a furniture box in a second configuration.

In a first exemplary method of use, referring to FIGS. 2, 3, 5, 6 and 8, a user places drawer slide 24 proximate jig 10 on the appropriate side of jig 10 for a particular installation. A bottom surface 84 of drawer slide 24 is positioned to rest upon ledge 16. The user slides or otherwise moves wedge 18 down channel 26 so that bottom surface 46 contacts top surface 82 of drawer slide 24, thereby frictionally securing the drawer slide 24 on jig 10 between ledge 16 and bottom surface 46 of wedge 18. The user may make a mark 98 (see FIG. 6) at a location on furniture box 32 to indicate a desired position for bottom surface 84 of drawer slide 24. The user places jig 10, with drawer slide 24 attached thereto, proximate side wall 74 of furniture box 32. Jig 10 is positioned so that top edge 92 of lower clamp plate portion 70 aligns with mark 98, to thereby position the bottom surface 84 of drawer slide 24 at the vertical position indicated by mark 98. A front end of drawer slide 24 is abutted against setback stop 100, which provides a 2 mm spacing between clamping surface 64 and front end of drawer slide 24. The user may manually hold jig 10 in position, as shown in FIGS. 3, 5 and 6 or hold the position of jig 10 relative to furniture box 32 with clamp 34, as shown in FIGS. 2 and 8. Thus held or clamped, drawer slide 24 is maintained at a desired position relative to furniture box 32 for installation thereon. The drawer slide 24 can then be attached to the furniture box 32. The user inserts fasteners 80 through apertures 58, 60 and 62 of jig 10 and into apertures (not labeled) in drawer slide 24 to attach drawer slide 24 to furniture box 32. Suitable fasteners 80 include screws installed using a drill 88, for example. The user releases clamp 34 if necessary and raises wedge 18 to detach jig 10 from drawer slide 24. The user may install additional fasteners 80 into drawer slide 24 and furniture box 32 as desired.

As shown in FIG. 2, a drawer slide 24*a* is supported between drawer slide bottom support ledge 16 and drawer slide top support wedge 18. As shown in FIG. 3, a taller drawer slide 24*b* is supported between drawer slide bottom support ledge 16 and drawer slide top support wedge 18. Drawer slide top support wedge 18 slides along inclined channel 26 to accommodate drawer slides 24*a* (FIG. 2), 24*b* (FIG. 3) and others of different heights.

FIG. 2 shows a partial perspective view of a front and interior of furniture box 32. A top drawer slide 24*a* is mounted on drawer slide support 72 on side wall 74 of furniture box 32. Jig 10 is clamped onto face frame cross rail 76 by clamp 34, which holds clamp plate 14 of jig 10 in a desired position relative to face frame cross rail 76 and slide support 72. Bottom surface 84 of drawer slide 24*a* rests upon drawer slide bottom support ledge 16 and top surface 82 of drawer slide 24*a* is firmly held by wedge 18 to maintain drawer slide 24*a* on jig 10 and in a desired position against drawer support 72 of side wall 74. Drawer slide bottom support ledges 16 extend from both sides of lower portion 50 so that jig 10 can support a drawer slide against left and right side walls 74 of a furniture box 32.

With upper portion 68 and lower portion 70 of clamp plate 14 aligned with left front face frame member 78, which is presumably oriented vertically, drawer slide bottom support ledge 16 extends in a horizontal direction to horizontally support drawer slide 24*a*. With drawer slide 24*a* thus supported by jig 10 against drawer slide support 72, a user can insert fasteners 80 through apertures 58, 60 and 62, for example, to secure drawer slide 24*a* to drawer slide support 72. In some embodiments, furniture box 32 may not have drawer slide support 72; in that case, drawer slide 24*a* may be attached directly to side wall 74. After drawer slide 24*a* has been secured, jig 10 may be removed from furniture box 32 by moving wedge 18 upward along channel 26 and opening clamp 34 to remove jig 10.

FIG. 3 shows a partial interior view of furniture box 32, in which a taller drawer slide 24*b* is supported by jig 10 by a user manually holding jig 10 by handle 12 against face frame cross rail 76 and left front face frame member 78. Comparing FIGS. 2 and 3, it can be seen that in FIG. 3, with a taller drawer slide 24*b*, drawer slide top support wedge 18 is positioned within channel 26 at a position that is higher and farther back than that shown in FIG. 2. Accordingly, jig 10 supports both the top surface 82 and the bottom surface 84 of sliders 24 of varying height.

The exact horizontal alignment of a drawer slide 24 supported by jig 10 is ensured by abutting the clamp plate 14 with the front wall, frame, or face of the furniture box 32. The slide rail support ledges 16 and the clamp plate 14 are formed substantially orthogonally to each other. Thus, assuming that the furniture box 32 being used is "square," (i.e., that the vertical walls and faces are at right angles to each other and are plumb with a horizontal bottom surface of the furniture box), installation of drawer slide 24 by abutting the clamp plate 14 with the front member 78 of the furniture box 32 in turn positions the drawer slide 24 supported on the ledge 16 in a horizontal orientation. This eliminates the need to use a leveling bubble or other level gauge on the jig, therefore enhancing ease of use.

Clamp plate 14 is formed on jig 10 so that jig 10 can be retained at the furniture box front wall, frame, for face by means of a clamp 34, such as a screw clamp for example, and need not be held manually. FIG. 8 shows an alternative clamping location, wherein clamp pad 102 of clamp 34*a* is secured to side surface 55 of support 54 (see FIGS. 4A and 4B). As shown in FIGS. 1, 4A and 4B, ledge 16 includes recess 104 located proximate support 54 to offer additional clearance for clamp pad 102. Additionally, in an exemplary embodiment, a gap is provided between front end 106 of ledge 16 and setback stop 100 of clamp plate 14 to accommodate downward projecting portion 108 as shown on the top drawer slide 24*a* of FIG. 2.

Figure 7:
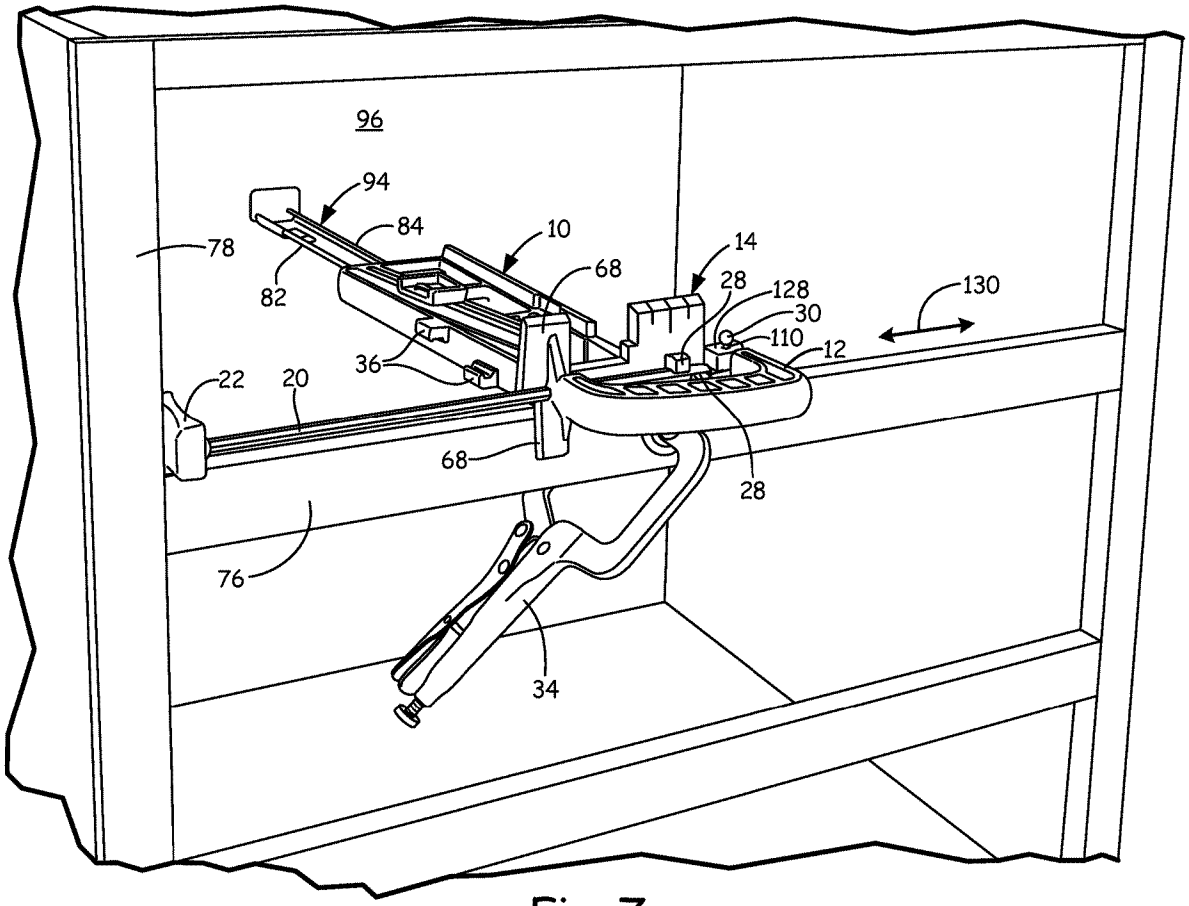
FIG. 7 is a perspective view of the jig clamped to a furniture box for installation of a drawer slide in a central space of the box.

As shown in FIGS. 4A, 4B, 5 and 7, indexing rod 20 is insertable into guides 28 on front portion 66 with foot 22 in an up or down position. Indexing rod 20 is insertable between guides 28, 128 by sliding in directions 130. Knob 30 can be used to tighten indexing rod 20 at a desired position of foot 22 relative to the body of jig 10 and relative to a reference location, such as a top, side, back or bottom wall or frame member of a furniture box or other structure (see FIGS. 1, 2, 5, 7 and 8, for example). While a rotating knob 30 is specifically shown and described, it is contemplated that other mechanisms for frictionally holding indexing rod 20 in a desired position relative to the body of jib 10 can also be used. Accordingly, jig 10 can be used to place subsequent drawer slides 24 at the same distance from a reference location on furniture box 32. In FIG. 5, the reference location is a bottom wall 86 of furniture box 32. In FIG. 7, the reference location is a surface of left front face frame member 78 of furniture box 32. It is contemplated that other reference positions can also be used, such as a right face frame member, a cross rail, or a top wall of a furniture box, for example. The use of indexing rod 20 with indexing foot 22 is particularly advantageous in the case where furniture box 32*a* does not have a face frame cross rail 76 proximate a desired location for the installation of a drawer slide 24. FIG. 5 illustrates an installation of drawer slide 24*c* on a left interior side wall 74 of furniture box 32. After removing jig 10 from the installed drawer slide 24*c*, indexing foot 22 remains in the same position with respect to jig 10. Thus, the user may move jig 10 proximate a right interior side wall of the furniture box 32*a* to mount a second drawer slide 24*c* at a same height as the drawer slide 24*c* shown in FIG. 5. Accordingly, pairs of drawer slides 24 for opposing sides of a drawer can be mounted at a particular height from a top or bottom reference surface or point without a need for measuring and marking each placement. This allows a user to easily, accurately and quickly place and align the pair of drawer slides for a particular drawer using a reduced number of steps but without compromising the function of the installed drawer.

FIG. 6 is a partial front perspective view of jig 10 and an exterior of furniture box 32. In an exemplary embodiment, lower clamp plate portion 70 of clamp plate 14 includes gauge markings 90. In an exemplary embodiment, gauge markings 90 are provided at half-inch increments. Further, in an exemplary embodiment, gauge markings 90 are provided as grooves in clamp plate 14 so that the markings 90 will not be rubbed off through extensive use of jig 10, as merely printed markings might be. Top edge 92 of panel 70 is aligned with the support surface of drawer slide bottom support ledge 16. A user may use gauge markings 90 or top edge 92 to place jig 10 vertically with respect to mark 98 or another reference surface, line, point, or the like.

FIG. 7 is a partial perspective view of jig 10 supported by clamp 34 on face frame cross rail 76 for installation of center mount drawer slide 94 against a back wall of 96 and cross rail 76 of furniture box 32. Center mount drawer slide 94 is frictionally held between wedge 18 and ledge 16 of jig 10 for retention thereby. Indexing rod 20 is used to set a distance between jig 10 and left front face frame member 78 of furniture box 32. This use of indexing rod 20 would allow a user to mount subsequent center mount drawer slides 94 at a set distance from left front face frame member 78. Indexing rod 20 may alternatively be used to set against another reference location, such as a right front face frame member, for example. As shown in FIG. 7, in an exemplary embodiment, knob 30 is attached to a threaded shaft 110 that extends through an aperture in guide 128. Turning knob 30 in one direction causes shaft 110 to be inserted deeper into guide 128, thereby contacting indexing rod 20 and pushing indexing rod 20 against an opposing guide 28, creating a frictional grip on indexing rod 20 that retains indexing rod 20 in a desired position with respect to the rest of jig 10. Turning knob 30 in an opposite direction causes shaft 110 to be released from contact with indexing rod 20, thereby allowing indexing rod 20 to slide in directions 130 between guides 28, 128.

In an exemplary embodiment, the body of jig 10 is integrally formed from a polymer such as foam-filled nylon. In this description, the "body" of jig 10 refers to all parts other than wedge 18, indexing rod 20, indexing foot 22, and knob 30. In an exemplary embodiment, wedge 18 and foot 22 are formed from acrylonitrile butadiene styrene (ABS). In an exemplary embodiment, indexing rod 20 is formed of steel and knob 30 is formed of brass. However, it is contemplated that other materials may also be used.

Although the subject of this disclosure has been described with reference to several embodiments, workers skilled in the art will recognize that changes may be made in form and detail without departing from the spirit and scope of the disclosure. In addition, any feature disclosed with respect to one embodiment may be incorporated in another embodiment, and vice-versa.

What is claimed is:

1. A tool for use in installing a drawer slide having opposing first and second surfaces, the tool comprising:

a ledge surface configured to support the first surface of the drawer slide, the ledge surface having a length oriented in a first linear direction; and a movable member having a movable member surface configured to contact the second surface of the drawer slide, wherein the movable member surface is parallel to the ledge surface, and wherein:

movement of the movable member changes a distance between the ledge surface and the movable member surface, wherein the distance is measured in a second linear direction that is perpendicular to the first linear direction;

the movement of the movable member occurs along a third linear direction that is fixed with respect to the first linear direction and that is angled with respect to both the first linear direction and the second linear direction; and the movable member is configured to exert pressure in the second linear direction to frictionally secure the drawer slide between the ledge surface and the movable member surface.

2. The tool of claim 1 further comprising an inclined channel in which a part of the movable member moves.

3. The tool of claim 2 further comprising:

a lower portion from which the ledge extends; and an aperture between the inclined channel and the lower portion.

4. The tool of claim 3 further comprising a support between the lower portion and the inclined channel.

5. The tool of claim 4 further comprising a recess in the ledge located proximate the support.

6. The tool of claim 1 further comprising a clamp plate oriented substantially orthogonally to the ledge.

7. The tool of claim 6 further comprising a gap between the clamp plate and the ledge.

8. The tool of claim 1 further comprising:

a body including the ledge; and a rod comprising a foot, wherein the rod is adjustably attachable to the body.

9. The tool of claim 8 wherein the body further comprises a plurality of guides through which the rod is insertable.

10. The tool of claim 9 wherein the plurality of guides are located on a top portion of the body.

11. The tool of claim 9 wherein the plurality of guides are located on a front portion of the body.

12. The tool of claim 8 further comprising a knob for selectively securing the rod relative to the body.

13. The tool of claim 1 further comprising a handle.

14. A method of using a tool to position a drawer slide proximate a furniture surface of a furniture box, the drawer slide having a first surface and a second, opposing surface, the method comprising:

positioning the first surface of the drawer slide on a ledge surface of the tool, the ledge surface having a length oriented in a first linear direction;

moving a movable member so that a movable member surface contacts the second surface of the drawer slide, wherein the movable member surface is parallel to the ledge surface, and wherein:

the second surface is spaced from the first surface at a distance measured in a second linear direction that is perpendicular to the first linear direction;

moving the movable member occurs along a third linear direction that is fixed with respect to the first linear direction and that is angled with respect to both the first linear direction and the second linear direction; and the movable member is configured to exert pressure in the second linear direction to frictionally secure the drawer slide between the ledge surface and the movable member surface;

placing the tool proximate the furniture surface; and attaching the drawer slide to the furniture surface.

15. The method of claim 14 wherein moving the movable member comprises sliding a part of the movable member along a channel that is inclined relative to the ledge.

16. The method of claim 14 further comprising inserting an indexing rod through a plurality of guides.

17. The method of claim 16 further comprising securing the rod at a desired location relative to a body of the tool.

18. The method of claim 17 wherein securing the rod at the desired location relative to the body of the tool comprises turning a knob to frictionally engage the rod against the body of the tool.

19. The method of claim 16 wherein the rod comprises a foot at an end thereof, the method further comprising locating the foot at a reference location on the furniture box.

20. The method of claim 14 further comprising clamping the tool to the furniture box.

* * * * *